US005547163A

United States Patent [19]

Lack

[11] Patent Number: 5,547,163

[45] Date of Patent: Aug. 20, 1996

[54] WEDGED TIEWIRE ASSEMBLED PLYFORM PANEL TO I-BEAM STAKES

[76] Inventor: Clarence A. Lack, 16759 Madrone St., Pioneer, Calif. 95666

[21] Appl. No.: 347,513

[22] Filed: Nov. 25, 1994

Related U.S. Application Data

[63] Continuation-in-part of Ser. No. 130,997, Dec. 15, 1993, abandoned.

[51] Int. Cl.[6] ..... E04C 2/12; E04C 2/34

[52] U.S. Cl. ..... 249/5; 249/4; 249/40; 249/46; 249/216

[58] Field of Search ..... 425/4, 3, 7, 5, 425/6, 33, 34, 38, 46, 213, 190, 193, 215, 216, 217, 40, 43, 45, 46, 47

[56] References Cited

U.S. PATENT DOCUMENTS

| | | | |
|---|---|---|---|
| 1,028,294 | 6/1912 | Simpson | 249/4 |
| 1,141,057 | 7/1915 | Heltzel | 249/4 |
| 1,692,166 | 11/1928 | Coates | 249/215 |
| 1,755,960 | 4/1930 | Kohler | 249/216 |
| 1,800,802 | 4/1931 | Miller | 249/215 |
| 1,875,136 | 8/1932 | Podd | 249/46 |
| 2,761,191 | 9/1956 | Anderson | 249/45 |
| 3,288,428 | 11/1966 | Terry | 249/40 |
| 3,728,836 | 4/1973 | Coates | 249/215 |
| 3,910,545 | 10/1975 | Langford | 249/7 |
| 4,066,237 | 1/1978 | Bentz | 249/4 |

*Primary Examiner*—Khanh P. Nguyen

[57] ABSTRACT

A wedged preformed single strand tiewire assembling of plyform panels to I-beam stakes securing construction forms laterally, vertically and horizontally which are assembled aligned, plumb and level; the forms are comprised of flat, tapered steel wedges, tiewire with open-looped ends for receiving wedges at each end, I-beam steel stakes of varying lengths, and plyform-faced panels whereby the stakes and panels have holes through which the looped ends of tiewire are placed, and the stakes and panels are wedged together into an erect, assembled form preparatory to forming walls over foundation footings.

7 Claims, 3 Drawing Sheets

18

18

9
8

9
7
10

17
15
16

16
15
16

WEDGED TIEWIRE ASSEMBLED PLYFORM PANEL TO I-BEAM STAKES

This application is a Continuation-In-Part of the application having Ser. No. 08/130,997, filed on Dec. 15, 1993, now abandoned.

BACKGROUND OF THE INVENTION

This assembly of tie-form panels was born out of current practices in the building construction trades, primarily in foundation work. Where there are several uses for the tiewire assembled plyform panels, for purposes of patent application, emphasis will be on the forming of walls, with concrete being the most commonly used material for building foundation walls.

Each tradesmen builds upon another's work; consequently, there is need for accurate and reliable workmanship prior to ones' own work. However, the trades are replete with shoddy workmanship and archaic construction practices. Although tools cannot entirely compensate for the absence of craftsmanship, the construction of foundations can be aided by improved foundation forming tools as represented by tie-form panels (in the following, the terms "tie-form" and "tie-form panels" will refer to wedged tiewire assembled plyform panels to I-beam stakes).

Even with the invention of several kinds of concrete forms, current trade practices in home construction still use dimension lumber nailed to wood stakes and held together with either foundation form ties or wire. The practice prevails with individual builders, concrete contractors and even tract home builders.

DESCRIPTION OF THE PRIOR ART

The analyses of each of the following inventions is ordered by date save for Gates and Sons.

| | | |
|---|---|---|
| 1028294 | 6/1912 | Simpson<br>Collapsible concrete form |
| 1141057 | 5/1915 | Heltzel<br>Sidewalk and road form |
| 1755960 | 4/1930 | Kohler<br>Concrete form holder |
| 1800802 | 4/1931 | Miller Tie |
| 1875136 | 8/1932 | Podd spreader clamp |
| 2761191 | 9/1956 | Anderson<br>Wall form and tie form<br>concrete construction |
| 3288428 | 11/1966 | Terry preassembled tie construction |
| 1692166 | 11/1928 | Gates structural form tie |
| 3728836 | 4/1973 | Gates concrete form tie and rebar chair |
| 4066237 | 1/1978 | Bentz adjustable form stake assembly |
| 4391429 | | Powell wedged wire panel tie |

Not having adequate or appropriate tools can be a definite disadvantage, seriously limiting how a job is done. Several attempts have been made to design better tools for concrete form work. Following is a comparison of prior form work to the form work presented herein for patenting.

The work of Simpson is specific to forming curbs along highways. The forms are designed for the top surface to be slanted where the top surface of the tiewire plyform panels are designed for a top flat surface to support a structure built thereon. Slotted plates are used to hold the sides in the desired position, a part not necessary in assembly of tie-form panels. Simpson's work is specific to forming highway curbs, whereas the tie-form panels are specific to foundations and work thereon.

The sidewalk and road form of Heltzel is specific thereto. As with Simpson, plates are used to support the sides. The method of fastening is for adjusting the sides in an upright position which is out of the scope of tie-form since the sidewalls of foundations are plumb. Furthermore, there is no need for brackets as is the case in Heltzel's sidewalk forms.

Where Kohler's concrete form holder can be easily pirated, there is no known present use of his forms. The slitted tie bars, although simple in construction, leave a space between the side boards which allows concrete to leak out. When the forms are taken down, the tie bars are difficult to remove and also leave holes in the formed walls. In addition, the size of tie bars is such that they cannot be cut off in place. Kohler's tie bars require the use of nails which are not needed in the assembly of tie-form panels.

Although Miller's tie serves to hold side boards out and against abutments (stakes), there is no mention or claim of the level, plumb or height of the assembled forms. How the side boards are held up is left unmentioned. Furthermore, as in Kohler's work, the ties are between the boards. Because the wires are twisted, they cannot be removed from the concrete without damaging it, and the ties either remain in the concrete and have to be cut off at each end, or are pulled out and fracture the green concrete during its initial set. In contrast, a straight, single-strand tiewire can easily be pulled out, leaving no more than a hole the size of pencil lead.

Podd's spreader clamp is designed for use with waling, i.e., false work. Waling or false work requires studs and purlins more commonly known as waling as used in concrete foundation form work. With both, studs need to be cut and fitted to the height desired for the particular job and then nailed together prior to the use of the spreader clamps. The design of tie-forms precludes the use of false work. In referring to the spreader tie and how it is used with false work, no mention is made of fastening to the ground or of lateral bracing as is afforded by the use of I-beam stakes with tie-forms. Also not mentioned is the cutting off of the exposed ends of the spreader clamp or the interference of these kinds of clamps with disassembly of the false work and panels, or the removal of the spreader clamps from the formed wall.

Anderson's wall form and tie is well designed to withstand excessive pressure resulting from high lift concrete pour and other specified objectives. However, where the face of Anderson's panels are attached to a metal frame by bolts or rivets, the face of the tie-form panels are either screwed or stapled in place. There are as many as four parts to the bolting assembly: bolts, nuts, a washer, and a lock washer. The bolts would have to have a flat head with a screw slot. The flat head would nest flush with the inside panel surface. The screw-slotted bolt head formed in this manner would keep the bolt from turning when screwing the nut onto or off of the opposite side of the panel. A workman would have to reach both sides of the panel to attach or remove the bolts. After a concrete pour, the slots in the bolt heads would be filled with concrete. If rivets were used, the bolt heads would have to be drilled out.

The inside face of the tie-form panels is protected with a panel release compound that keeps the heads of the screws from clogging up with concrete. Where Anderson uses either wood or metal panel facing, tie-form panels are made of a corrosion-resistant multiple composite material such as fiberglass or a polymer-faced plyform, but not limited thereto.

The notched protruding edges of Anderson's wall form and tie serve to align panels with tie bands and also keep concrete from leaking out. With the tie-form panels, no protruding edges are needed since the full sides of the panels join each other. By Anderson's own admission, the protruding edges need reinforcing to protect them from damage. This problem does not exist with the tie-form panels.

There is no mention of how aligning members of the wall form and tie (such as channel iron) maintain their own stationary position while fastened to the panels. In tie-form panels, the I-beam stakes hold the assembled forms plumb, level, and in horizontal alignment by being driven into the ground. Anderson's C channel for alignment is not a stake, and its alignment is ambiguous.

Where bracing is referred to, it is welded cross iron within the structure of the panel.

Where iron tie bands are used in assembly, no mention is given to what happens to the protruding ends of the tie bands when forms are disassembled. They are not broken, snapped or cut off, nor are they pulled out. Where the formed surface of the concrete is true, the bands present a problem when they are cut off (which is time consuming), so they are left in place. The tiewire for tie-form panels can be snipped off and pulled entirely out. Where pencil-lead-sized holes in basement walls may appear to be a problem, troweling on bentonite, Thoroseal or tar easily water-proofs a wall so formed. Accordingly plastering or painting above-ground walls easily covers and seals such small holes, or simply troweling the green cement closes such small holes.

There is no description of the wedges used to fasten the tie band to the C channel, nor is there a description of how the wedges are removed. The wedges used in the tie-form panel assembly are removed by a slight tap from underneath and then pocketed for reuse.

Where Anderson makes no mention as to the kind of walls for which his forms are used, the structure of the panels is closest to that currently used in commercial and industrial applications. The tie-form panels are most appropriately used in residential work, but Anderson's panels do not appear to be useful for residential work.

Where Podd specifically mentions that his invention is assembled with walers (false work), Anderson remains silent on how his panels are most adaptable to the same kind of form work. The C channels replacing the wood studs, the remaining form work using walers and a highly-developed bracing system for industrial construction are outside of the scope of this patent application.

Terry's preassembled tie construction had been assigned to Dur-O-Wall National Inc. which currently markets a welded webbed wire used as horizontal reinforcing in cinderblock walls. Limitations within Terry's preassembled tie construction has precluded continued marketing. Where the wire webbing resists shear and bending forces within the assembled form, there is too little resistance to tilting of the entire form. The bottom edge of the forms pressed into freshly poured footings affords no rigid support nor any structural means for level forms. Pressing the bottom edge into firm dirt in the footings is precluded by the building code. Rust would travel up the wires through the stem wall and weaken it.

Setting up the preassembled tie construction after pouring the footings increases the cost of stand-by time for concrete trucks. Time is also limited from when the concrete is mixed to the initial set of the concrete. This limited time for pouring concrete precludes setting up side bracing which, if possible, would in turn increase the cost of delivered premixed concrete. Form work needs to be completely done prior to delivery of ready-mixed concrete to prevent concrete from setting up inside the ready-mix concrete trucks.

Stripping the forms away from the green concrete to prevent the bottom of the forms from getting locked in the concrete risks damaging the concrete. Torquing off the ends of protruding tie wire also scrapes a hole in the finished wall. The exposed wire abutments provide channels of rust through the stem wall.

Concrete is corrosive when it contacts aluminum, so aluminum is not used. The alternate use of wood panels fastened to wire webbing leaves form wood locked in concrete thus attracting termites.

Terry's preassembled tie construction is designed to function without stakes and hence its lacks the advantages thereof. Terry's aluminum panels and welded wire would have to be redesigned to use stakes and lateral bracing. Independent and apart from the preassembled tie construction, tie-form panels are designed to use stakes for plumb, level, and horizontal alignment.

In using stakes with Terry's preassembled tie construction, what may appear as obviously favorable nevertheless leaves several design problems to solve: Where the need may be obvious to stake the preassembled tie construction (which it was designed to preclude), doing so requires a totally different panel and tiewire design; additionally, the design of the stake depends on both the panel and tiewire designs.

For Dur-O-Wall to hold a patent and not market the product indicates that there is an obvious need whose solution has not been found. The tie-form panels, a wedged tiewire assembly of plyform panels to I-beam stakes, meets that need through a different design approach.

Gates' structural form tie and concrete form tie and rebar chair are both made of twisted wire form ties. The structural form tie is an earlier work of Gates. Gates' analysis of the malfunction of his earlier work when applying for a patent on the form tie with rebar chair precludes any comment here on his earlier work except to refer to disadvantages carried over into his more recent patented design.

The extensive knowledge and experience of Gates and Sons from 1928 to 1973 did not lead them to solve a need inherent in prior arts. The pipes inserted through the looped ends of the tie wire are in a horizontal position which leaves stacking independent of the tie-form assembly. In the tie-form panel assembly, the stakes are integral with the wedged tiewire. This difference also exists in regard to waling and false work: In false work, bracing is separate from form ties; in tie-form panels, bracing is integral with the form ties.

The concrete form tie with rebar chair holds the side panels out as well as keeping them from spreading in width. The form tie does not hold the panels up as do tie-form staked panels. A separate, extra movement is required to nail Gates' form to stakes.

In tie-form panels, the tiewire ends are identical so that differently-shaped ends do not have to be identified as in Gates design.

The twisted concrete form tie fits into slots at the top of the panels. Alternate ties would have to be reversed with the rebar chair facing down to hold the lower panel out which would obviate the rebar chair claim.

Twisting wire lessens its tensile strength; hence, the wire is doubled. Twisted wire has a memory of its prior form. Under stress, the wire tends to untwist into its original shape. This allows for variation in width of the forms.

The absence of reinforcement at the top and bottom of the panels necessitates using ½" to ¾" plywood which is heavy to handle. Furthermore, the variation in panel width necessitates differently-sized tiewire to compensate for the different panel sizes to maintain uniform stem wall thickness. The tie-form panels are of uniform thickness, namely 1½" to allow for joining with standard lumber, a versatility not available in other forming systems.

Bentz's adjustable form stake assembly is designed in keeping with its stated purpose, namely flat work. Where Bentz's stake design is integral with the tie rod, the structural support for width and elevation consists of two separate parts rather than a singular member serving both functions as in the tie-form panel assembly. The tie rod determines the width of flat work. The central bore through the shank of a carriage bolt is used for nailing side boards to the stake. In all, nine parts are use to hold the forms in place; in tie-form panels, only three parts are used.

The tie rod across the top edge of the form boards interferes with striking the poured concrete. In tie-form panels, the tops of the forms are free of intervening members. In addition, the slotted steel stakes are subject to deformation when driven into the ground, even when they are short.

Tie-form panels designed for forming walls are not adaptable to flat work, nor is Benz's adjustable form stake assembly adaptable to forming walls. Long stakes centrally slotted for stacked boards to attain wall height would easily split when driven into the ground. A carriage bolt would be needed to nail each board to the stake which yields a cumbersome assembly of separate parts. The two systems of form work, although having some similarities, are different tools for different jobs: the adjustable form stake assembly lacks many of the advantages stated as objectives for the tie-form panels.

In comparison with the structure of the adjustable form stake assembly and the stated objectives, several limitations become readily apparent. The tie rod and carriage bolt do not prevent the stakes from moving back and forth in line with the length of the boards; the carriage bolts act as a pivot, and the tie rod slips along the top of the boards. In the tie-form panel assembly, the top and bottom tiewires wedged to the stake hold the stake in a vertical position. In using the long rods, there is no predetermined width of the forms. The rods are intentionally used for variable widths in flat work. In the tie-form panel assembly, the preformed tiewire is specifically sized for conventional widths of stem walls.

In Bentz's form work, there is a notable absence of panels which have holes for suspension by tiewire. The purpose of Bentz's form work does not require panels. Boards are suitable and functional for flat work. Tie rods within the poured flat work presents a problem when long rods are withdrawn from the concrete, and holes are left the size of the false work: In false work, bracing is separate from form ties; in tie-form panels, bracing is integral with the form ties.

The concrete form tie with rebar chair holds the side panels out as well as keeping them from spreading in width. The form tie does not hold the panels up as do tie-form staked panels. A separate, extra movement is required to nail Gates' form to stakes.

In tie-form panels, the tiewire ends are identical so that differently-shaped ends do not have to be identified as in Gates design.

The twisted concrete form tie fits into slots at the top of the panels. Alternate ties would have to be reversed with the rebar chair facing down to hold the lower panel out which would obviate the rebar chair claim.

Twisting wire lessens its tensile strength; hence, the wire is doubled. Twisted wire has a memory of its prior form. Under stress, the wire tends to untwist into its original shape. This allows for variation in width of the forms.

The absence of reinforcement at the top and bottom of the panels necessitates using ½" to ¾" plywood which is heavy to handle. Furthermore, the variation in panel width necessitates differently-sized tiewire to compensate for the different panel sizes to maintain uniform stem wall thickness. The tie-form panels are of uniform thickness, namely 1½" to allow for joining with standard lumber, a versatility not available in other forming systems.

Bentz's adjustable form stake assembly is designed in keeping with its stated purpose, namely flat work. Where Bentz's stake design is integral with the tie rod, the structural support for width and elevation consists of two separate parts rather than a singular member serving both functions as in the tie-form panel assembly. The tie rod determines the width of flat work. The central bore through the shank of a carriage bolt is used for nailing side boards to the stake. In all, nine parts are use to hold the forms in place; in tie-form panels, only three parts are used.

The tie rod across the top edge of the form boards interferes with striking the poured concrete. In tie-form panels, the tops of the forms are free of intervening members. In addition, the slotted wooden stakes are subject to splitting when driven into the ground, even when they are short.

Tie-form panels designed for forming walls are not adaptable to flat work, nor is Benz's adjustable form stake assembly adaptable to forming walls. Long stakes centrally slotted for stacked boards to attain wall height would easily split when driven into the ground. A carriage bolt would be needed to nail each board to the stake which yields a cumbersome assembly of separate parts. The two systems of form work, although having some similarities, are different tools for different jobs: the adjustable form stake assembly lacks many of the advantages stated as objectives for the tie-form panels.

In comparison with the structure of the adjustable form stake assembly and the stated objectives, several limitations become readily apparent. The tie rod and carriage bolt do not prevent the stakes from moving back and forth in line with the length of the boards; the carriage bolts act as a pivot, and the tie rod slips along the top of the boards. In the tie-form panel assembly, the top and bottom tiewires wedged to the stake hold the stake in a vertical position. In using the long rods, there is no predetermined width of the forms. The rods are intentionally used for variable widths in flat work. In the tie-form panel assembly, the preformed tiewire is specifically sized for conventional widths of stem walls.

In Bentz's form work, there is a notable absence of panels which have holes for suspension by tiewire. The purpose of Bentz's form work does not require panels. Boards are suitable and functional for flat work. Tie rods within the poured flat work presents a problem when long rods are withdrawn from the concrete, and holes are left the size of the rod. The structural form and function of interrelating parts of the two systems are necessarily dissimilar by the nature of the work they do.

Powell's tie-form panels structurally interfere with stacking. The top metal angle prevents panel alignment with a stake. The bottom of the panels become locked into concrete when they are not immediately removed while the concrete is still green. It is not possible to stake the forms, for no structural means is provided to do it. No provision is made for a cross bracing attachment to the top metal angle.

Top and bottom same-sized panel reinforcement allows for full parallel alignment of tie-form panels with a stake.

The size of the panel reinforcement at the bottom of the panels help prevent capture when the concrete flows out around the bottom of the panel at the foundation footing. Tie-form panels stack against stakes holding them in place. Where the need for stakes exits with Powell's tie form, the design precludes them.

Powell's panels work differently and are made of different materials than tie-form panels. The longitudinal reinforcement at the top and bottom of tie-form panels prevents flexing between ties. The top and bottom are reversible. The size of the reinforcing prevents locking in concrete. The size also positions the rebar within code-designated embedment. The reinforcing provides support at the stake for both the top and bottom of the panel. The use of wood reinforcing allows for nailing cross bracing as well as temporary positioning of panels to stakes. Nails are also an alternative to wire ties at the bottom of the panels.

The shape, location and position of the slotted holes in both stake and panel had to be designed so a stake could be used. Not obvious was the design of the slotted holes for more than just use of a stake with the tiewire. The design facilitates concurrent assembly of both sides of the form, and allows for complete removal of the tiewire along with disassembly of the forms. The removal of tiewire in other forming systems does not appear possible. Removal of the tiewire has an advantage of allowing the concrete to be finished free of any defect.

The stake itself is a structural member serving several functions. It is designed to withstand pounding into the ground. The I-beam shape allows for slotted holes in the web of the I-beam. The rigidity of the I beam resists deformation under both bending and tension and holds its upright position in three directions of alignment: in height, laterally and in a straight line front to back.

The tiewire is shaped to fit both panel and stake. When joining the panel to the stake, the tiewire is turned 90° after initial entry to pass through both the panel and the stake. This allows the opposite end to stay clear for positioning the opposing panel and stake. When the opposite panel and stake are in position, the tiewire is brought back to be positioned at both ends in the opposing panels and stakes.

The tie-form panels (a wedged tiewire assembly of plyform panels to I-beam stakes) accomplish something which has not previously been done: the stakes are integral, interrelating members of the entire assembly. They integrate several separate functions into a singular assembly and thus overcome the disadvantages of prior arts and prevailing current trade practices in form work. The advantages over prior work are stated as objectives for the tie-form panel assembly.

SUMMARY

A stem wall construction form assembly consisting of a wedged tiewire assembly of plyform panels to I-beam stakes. The I-beam stakes have horizontally slotted holes and are spaced to line up with horizontally slotted holes in wood frame supported panels for the insertion of preformed tiewire. The ends of the wire are bent back towards to midsection forming slotted extensions from the midsection. The slotted extensions are inserted through both panel and stake and extend beyond the stake to receive a wedge within the slotted protrusions. Each end turned back towards the midsection is bent up to hold against the inside face of the panel when a wedge is forced down into the protruding slotted extension which draws the panel up to and against the stake. The stake holds the panel vertical at a fixed height and resists bending to the side. The fixed length of the preformed tie wire predetermines the width between the opposing side panels.

DETAILED DESCRIPTION OF THE DRAWINGS

The following is a detailed descriptive analysis depicting each part in each drawing specifying their structure and interrelationships in preferred assembly but not limited thereto, there being several alternate modifications to said assembly.

Figure 1:
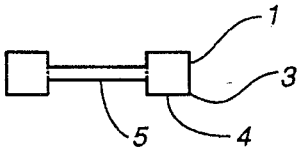
FIG. 1 is a cross section of an I-beam stake.

FIG. 1 is a vertical side view of an I-beam stake 1 showing horizontally slotted holes 2.

Figure 2:
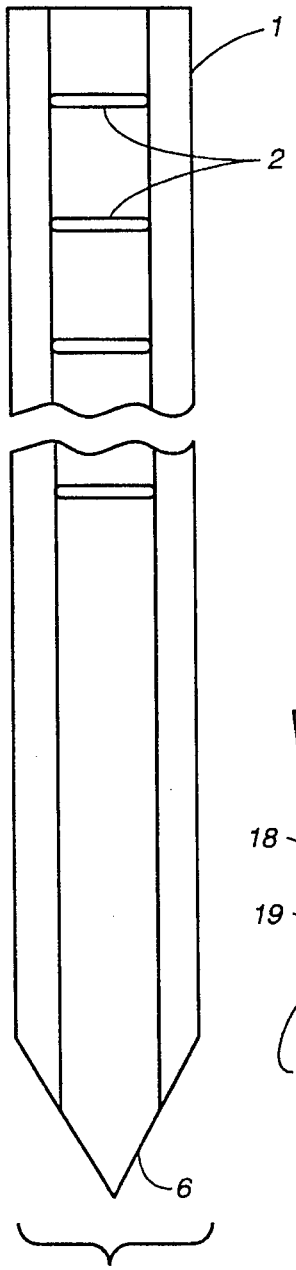
FIG. 2 is a side view of an I-beam stake.

FIG. 2 is a steel I-beam stake 1 with horizontally slotted holes 2. The holes are horizontally slotted to allow a tiewire 15 with ends returned towards its midsection and bent up at that point 16 to be able to pass entirely through the hole in the stake when the tiewire 15 is turned 90° to its final assembled position. The holes are also slotted horizontally to allow for tolerance in alignment with panels while assembling the panels to the stakes. The cross section of the stake in FIG. 1 shows its I-beam structure formed to withstand hammering into the ground. The thickened flanges 4 strengthen the narrow central web 5 against deformation. The I-beam construction holds better in the ground than either a rectangular or round stake. The pointed end 6 facilitates driving into the ground. Stakes are of varying lengths to accommodate singular or stacked forms.

Figure 3:
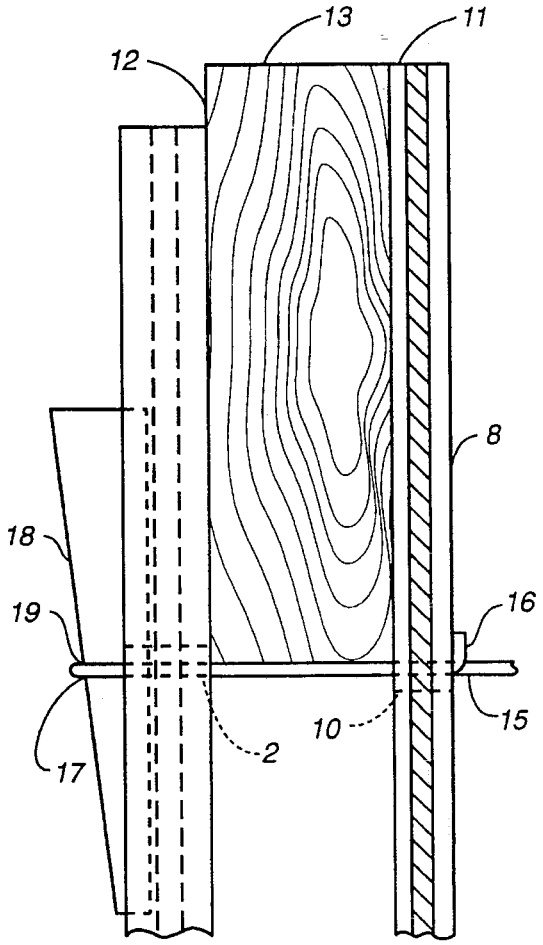
FIG. 3 is a detailed tiewire panel-to-stake assembly.

FIG. 3 is a detailed tiewire panel-to-stake assembly.

Figure 4:
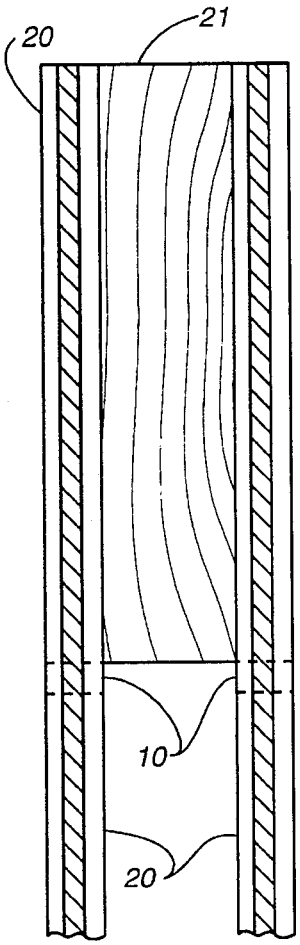
FIG. 4 is an alternate, double-sided panel form.

FIG. 4 is an alternate, doubled panel 20 configuration faced with a reinforcing treated wood frame 21 at four sides between the double-sided panel 20.

Figures 5, 6, 7, 8, 9, 10:
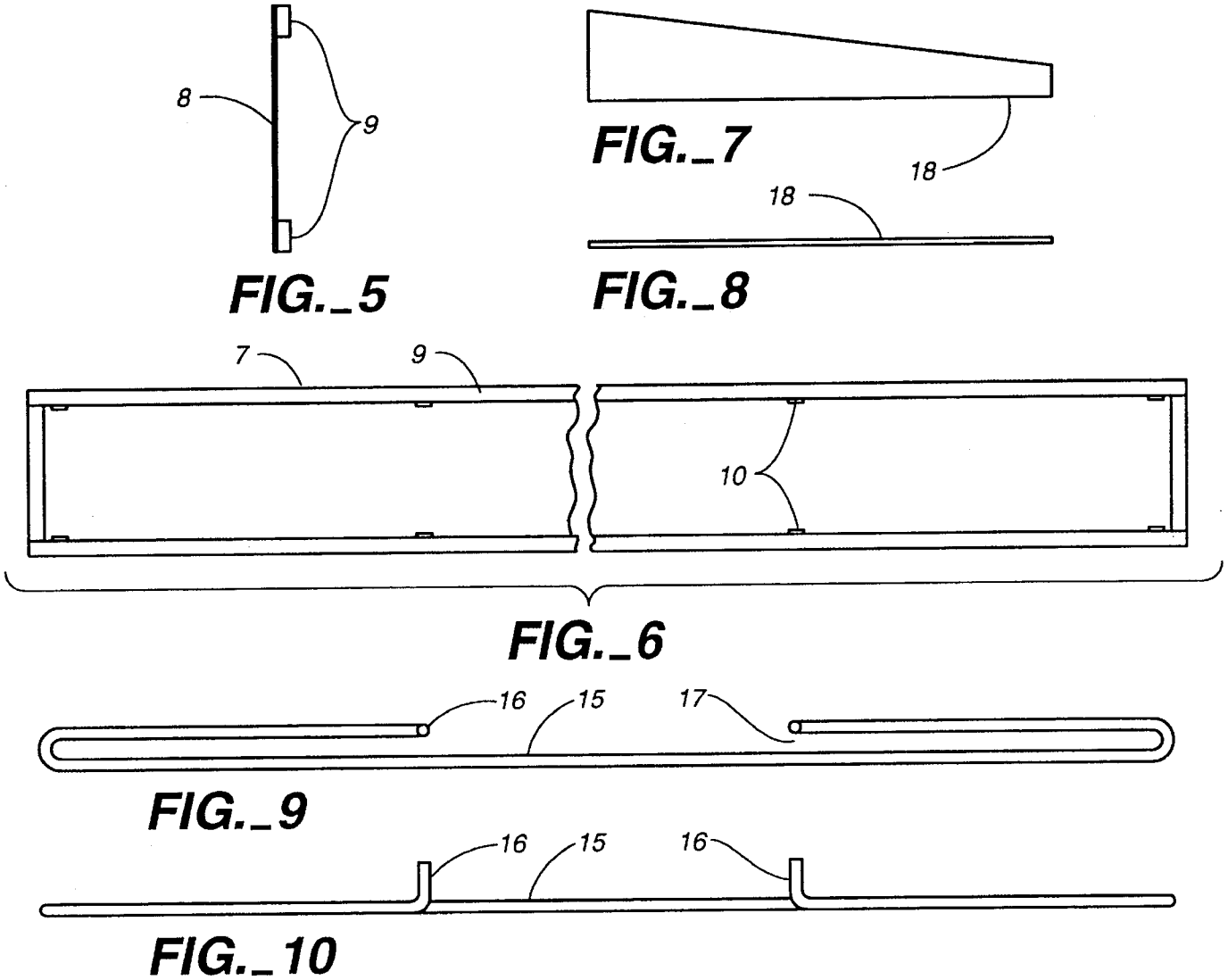
FIG. 5 is a cross section of a panel.
FIG. 6 is a back side view of a panel.
FIG. 7 is a side view of a wedge.
FIG. 8 is an edge view of a wedge.
FIG. 9 is a top view of a tiewire.
FIG. 10 is a side view of a tiewire.

The cross section of the plyform panel in FIG. 5 shows the top and bottom reinforcing wood frame 9. The wood frame is attached to all four sides of the panel facing. The frame edges are flat 11 against the edges of the panel facing. This allows the ends to contact fully when horizontally aligned, and the top and bottom fully contact when stacked. Because they fully contact each other, the panels keep concrete from seeping through joining panels.

The long side 12 of the top and bottom wood reinforcing panel frame is dimensioned for correct embedment of rebar within concrete foundation stem walls. The wood frame when attached to the panel facing is sized to the same dimension 13 of stock lumber when staked on edge against the stakes. This versatility allows for the height of the final assembled forms to be varied in addition to the different panel heights of the panels themselves.

FIG. 6 is the outside (backside) vertical view of a plyform panel 7 so named because of the composition of the composite facing 8 attached to the frame 9. The inside surface of the panel is of a noncorrosive composition in contact with construction materials. The plyform facing may be attached to the frame by either phillips flat heat stainless steel screws or by stapling with a power tool. The plyform panel has horizontally slotted holes 2 similar in size and function to those described in FIG. 2. The holes are located adjacent to the side of the reinforcing framing facing the middle of the panel. The frame gives support to the bent ends of the tiewire, catching against the inside face of the panel. This position is shown in FIG. 3.

FIG. 7 is a side view of the wedge 18. The tapered length is for drawing the panel up to the stake.

FIG. 8 is an end view of the wedge 18 with a width dimensioned to fit into the extended looped ends of tiewire as shown by 19.

FIG. 9 is a top view of the tiewire 15 showing the bent up ends 16 returned back towards the midsection forming slots 17 at each extension out away from the midsection. The bent up ends catch against the inside surface of the panel. The slotted extensions 17 of the tiewire are elongated to extend through both panel and stake 19 and receive a wedge 18 into the protruding end of the tiewire.

FIG. 10 is a side view of the tiewire 15 showing the bent ends of the wire 16.

Figure 11:
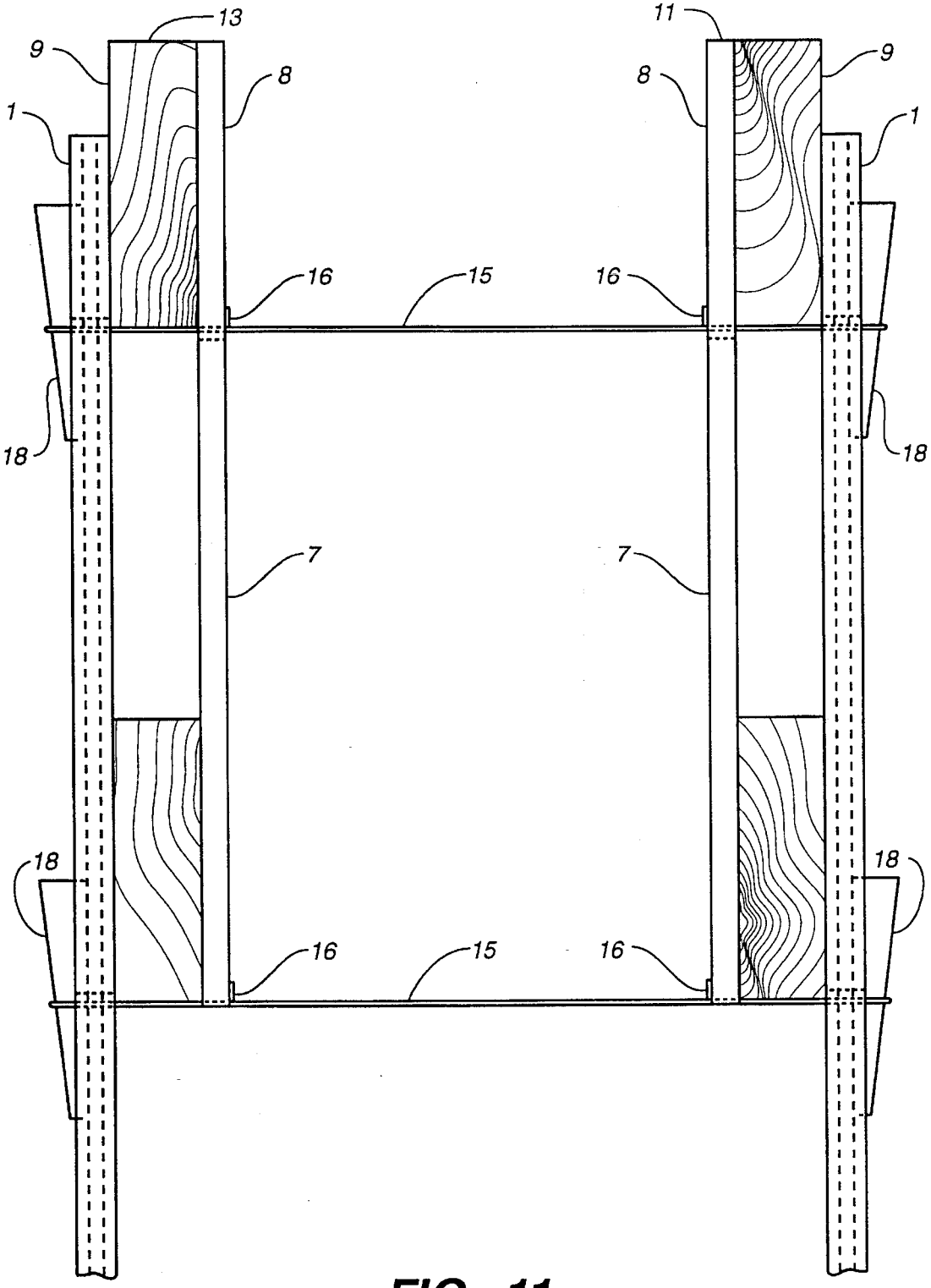
FIG. 11 is a vertical cross section of an assembled foundation form.

FIG. 11 is an assembly of a panel 8 to stakes 1 held in place by wedged 18 tiewires 15.

TIE-FORM PANEL OBJECTIVES

Wedged tiewire assembled plyform panels to I-beam stakes have been designed in accord with the following objectives, several of which are advantages over prior work.

The tie-form panels are adaptable to current trade practices. The assembled panels start with setting up batter boards and string lines as is currently done.

Each part is similar in structure and function to materials presently found on job sites, namely stakes, panels,wire and wedges, yet each is slightly modified in form to fit into an assembly not currently known.

Each part can be used separately along with other materials in other forming practices independent of the completely assembled tie-form panels. Tie-form panels can be nailed to wooden stakes. The I-beam steel stakes can be used with staked dimension lumber. The wedges can be used with Simpson form ties. The tiewire can be nailed to the forms.

The required tools are: tape measure, transit, level, rafter square, sledge, pencil and common tools already in a workman's toolbox.

The sequence and method of assembly of separate parts is the same as in current practice.

The tie-form panels are constructed of seasoned, milled, graded lumber assuring true straight-line linear alignment.

The tirewire is of uniform length holding the assembled panels to a uniform width under pressure.

The tie-form panels can be assembled level within a tolerance of 1/16". The assembled forms remain free of deformation, buckling, flexing and misalignment during concrete pouring and curing.

The forms can be assembled and disassembled by one man for an entire house foundation, or work can be done cooperatively with a two to three man crew.

The forms require low maintenance. The panels are scraped and sprayed with a light oil, possibly number 2 diesel fuel after use prior to storage. Each part, save the tiewire, is reusable several times over. The forms are easily repaired from available stock materials precluding the necessity of a large inventory.

All of the individual parts are replaceable.

The forms are light in weight for ease of continual handling by one man throughout a working day. The forms and stakes are stackable and the wedges and tiewire conveniently boxed for ease in storage and transportation. The tie-form panels are strong enough to withstand abusive handling.

The assembled forms are designed to resist an outward pressure of 2000 lbs. per square foot, the tiewire being of required gauge and tensile strength. The entire assembly is held in place by a single locking device. The assembled forms are useful together with stock dimensional lumber stacked either above or below the plyform panels.

Machining of separate parts requires a minimum set of jigs. "Home shop" fabrication of separate parts is feasible. The forms are flexible in varying heights, depths, and widths.

The assembled forms leave the entire top surface of poured concrete free of any interference in striking off and finishing in preparation of setting foundation bolts and setting down the mudsill.

The mudsill can be positioned over the foundation bolts during the initial set of the concrete. The assembled tie-form panels are adaptable to forming stem walls, retaining walls, basement walls, curved walls, and terracing.

The forms are workable with several kinds of building materials such as, but not limited to, concrete, adobe, rammed earth and faced masonry. The forms can be used as slip forms when working with rammed earth or rock.

The assembled forms allow unobstructed placement and support of rebar.

The tiewires are located for placement of rebar in accord with dimensions for embedment of the rebar in the concrete as required by building code regulations. The tie-form panels have noncorrosive surfaces in contrast with the forming material. The forms are cross braced independent of walers.

The assembled forms are free of interference to spraying the inside face of the panels with form release prior to placement of rebar. The forms can be disassembled without damage to the green concrete.

By cutting off the looped inside of the tiewire, the tiewire can be completely pulled out and away from the formed wall.

The depth of the tie-form panels are sized to form the correct stem wall height with just a single panel, precluding stacking of separate boards.

The forms are adaptable to stepped foundations up or down grade.

The slotted holes are spaced for stepped foundation form work in a 2 foot module.

The tiewires serve as support for end board risers in a stepped foundation.

ASSEMBLY AND DISASSEMBLY OF FORMS

Wedged tiewire assembled plyform panels to I-beam stakes as hereinafter described is in accordance with the aforementioned objectives and the claims state later on. This does not exclude modifications to or alternate forms of the assembled concrete form work.

As in standard trade practice preparatory to setting up concrete form work, batter boards are set up for digging foundation footings. After this is done, the I-beam stakes 1 are driven into the ground in alignment with the string lines. A stake is positioned along the outside of the line to correspond with the position of the holes 10 in the panel 7. A panel 7 is held up to the stake while the holes 10 in the panel are positioned opposite those 2 in the stake. A tiewire 15 is inserted through both panel and stake so the bent up end 16 catches against the inside face of the panel 8. A wedge 18 is inserted down into the slotted end of the tiewire 17 sticking out beyond the stake 19. This procedure is done at the opposite end of the panel, and only a level is used to select a slotted hole 2 in the stake that is slightly high. When the panel 7 is wedged 18 to the stake 1, the stake 1 is tamped into the ground until the panel 7 is level. The entire outside perimeter is erected following the same procedure. When the perimeter is enclosed, the level is checked and corrected for any variance from the beginning to the end. This can be done by using a level or transit. An alternate method is to premark the stakes for height prior to attaching the panels by using a transit for uniform level of the entire perimeter.

An inside panel 7 is positioned onto the end of the tirewire 15 first wedged 19 to the outside panel so that the bent up end of the tiewire 16 catches against the inside surface of the panel. This predetermines the placement of the stake directly opposite the outside stake, and at a predetermined width of the finished assembled forms. The tiewire 15 is then repositioned through both panels 7 and opposing stakes 1. The inside stake 1 is tamped for level across the forms. The opposite end of the inside panel 7 is staked in a similar manner. The panels are further set inside until they close with first panel put up to the inside of the perimeter foundation. Intermediate stakes 1 and tiewires 15 are wedged 19 to the middle of the panels already in position. As needed to provide stability and rigidity in the forms during the concrete pour, stakes can be diagonally driven into the ground and then nailed to the top of the panels.

Disassembly of the wedged tiewire assembled plyform panels 8 to I-beam stakes 1 starts with a slight tap to the bottom of the wedges 18 which removes them from the tiewire 15 that will be pocketed for future use. The stakes 1 are then pulled back away from the panels 7 and pulled out of the ground. The panels 7 are then free to be pulled off the tiewire 15. The tiewires 19 can be left in place or cut off with side cutting pliers close to the face of the formed wall. If so desired with walls of any height or where both sides of the wall are exposed to view and or traffic, the tiewires 15 can be completely pulled out from the side opposite the cut off end leaving a wall surface free of defect, damage, deformation or protrusions of any kind. The pencil-lead-sized holes are easily troweled or painted over. The wedges 18, stakes 1, and panels 7 can be used several times over. The panels 7 are scraped and then sprayed with a light oil prior to stacking and storage.

I claim

1. A concrete form assembly comprising two spaced-apart opposing form panels, at least two opposing holes formed on the panels, two frames each fastened to a back side of each of said form panels for reinforcing said form panel, two I-beam stakes each having at least one elongated slot being aligned with said opposing holes of the panels, a tie wire comprising two first bent portions defining two slotted extensions at the ends of the tie wire and two second bent portions located at open ends of said slotted extensions wherein said tie wire extends through the holes of the form panels and the slots of the stakes, and two wedges each extending through the slotted extension with the second bent portions of the tie wire catching against front surfaces of the form panels to secure the stakes, the frame and the form panels into an operating position.

2. The concrete form assembly required in claim 1 wherein the form panels are made of plyform conposite material.

3. The concrete form assembly as required in claim 1 wherein the frame extends along four sides of the form panel.

4. The concrete form assembly as required in claim 1 wherein the frame is made of treated wood.

5. The concrete form assembly as required in claim 1 wherein each of the form panels comprises a doubled panel which includes two parallel plates defining two molding surfaces.

6. The concrete form assembly as required in claim 5 wherein the reforcing frame is disposed between the parallel plates of the doubled panel.

7. The concrete form assembly as required claim 5 wherein the molding surfaces are reversible.

* * * * *